US007160136B2

(12) United States Patent
Zhang et al.

(10) Patent No.: US 7,160,136 B2
(45) Date of Patent: Jan. 9, 2007

(54) ELECTRICAL CONNECTOR WITH LATCHING ELEMENT

(75) Inventors: Qing-Wen Zhang, ShenZhen (CN); Xian-Kui Shi, ShenZhen (CN); Yi Zhou, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/397,451

(22) Filed: Apr. 3, 2006

(65) Prior Publication Data

US 2006/0223356 A1 Oct. 5, 2006

(30) Foreign Application Priority Data

Apr. 1, 2005 (CN) ..... 2005 2 0070407

(51) Int. Cl.
*H01R 13/627* (2006.01)

(52) U.S. Cl. ..... 439/357; 439/354; 439/483; 439/923

(58) Field of Classification Search ..... 439/352, 439/354, 357, 358, 483, 923
See application file for complete search history.

(56) References Cited

U.S. PATENT DOCUMENTS

| | | | | |
|---|---|---|---|---|
| 5,643,003 | A * | 7/1997 | Myer et al. | 439/352 |
| 5,938,470 | A * | 8/1999 | Kashiyama | 439/489 |
| 6,129,593 | A * | 10/2000 | Aoyama et al. | 439/701 |
| 6,485,315 | B1 * | 11/2002 | Hwang | 439/108 |
| 6,585,537 | B1 * | 7/2003 | Lee | 439/358 |
| 6,655,979 | B1 * | 12/2003 | Lee | 439/357 |

* cited by examiner

*Primary Examiner*—Tho D. Ta
(74) *Attorney, Agent, or Firm*—Wei Te Chung

(57) ABSTRACT

An electrical connector comprising: a base having a front port and a rear end; a number of contacts received in the base and exposed to the front port; a number of cable wires each connected through the rear portion to a corresponding contact; a latching element being integrally formed with the base and extending rearwardly; and a block disposed rearwardly of the latching element on the rear end of the base. Additionally, the block can assist in conveniently connecting/disconnecting the connector to/from a mating connector.

8 Claims, 4 Drawing Sheets

ELECTRICAL CONNECTOR WITH LATCHING ELEMENT

BACKGROUND OF THE INVENTION

1. Field of the Invention

The present invention relates to an electrical connector, and more particularly to a cable connector which has a properly protected latch mechanism.

2. Description of Related Art

It is known to equip mating connectors with latch mechanism in order to ensure reliable interconnection. Such connectors have individual integrally formed insulative housings receiving a number of contacts as well as intermateable latching elements. When the two insulative housings are mated, the contacts are electrically connected and the latching elements are latched to each other.

In use, however, the mating connectors might be manipulated by users not familiar with their structures. For instance, these connectors might subject to maintenance by office personnel who oftentimes performs connecting/disconnecting operations in such a way that one or both of the latching elements are improperly manipulated to the extent of being inadvertently damaged.

Therefore, a need exists to properly guard the latching elements against improper operation or manipulation.

SUMMARY OF THE INVENTION

An object of the present invention is to provide an electrical connector that can effectively protect a latching element thereof.

To achieve the above object of the present invention, an electrical connector is proposed which comprises: a base having a front port and a rear end; a plurality of contacts received in the base and exposed to the front port; a plurality of cable wires each connected through the rear portion to a corresponding contact; a latching element being integrally formed with the base and extending rearwardly; and a block disposed rearwardly of the latching element on the rear end of the base. Additionally, the block can assist in conveniently connecting/disconnecting the connector to/from a mating connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
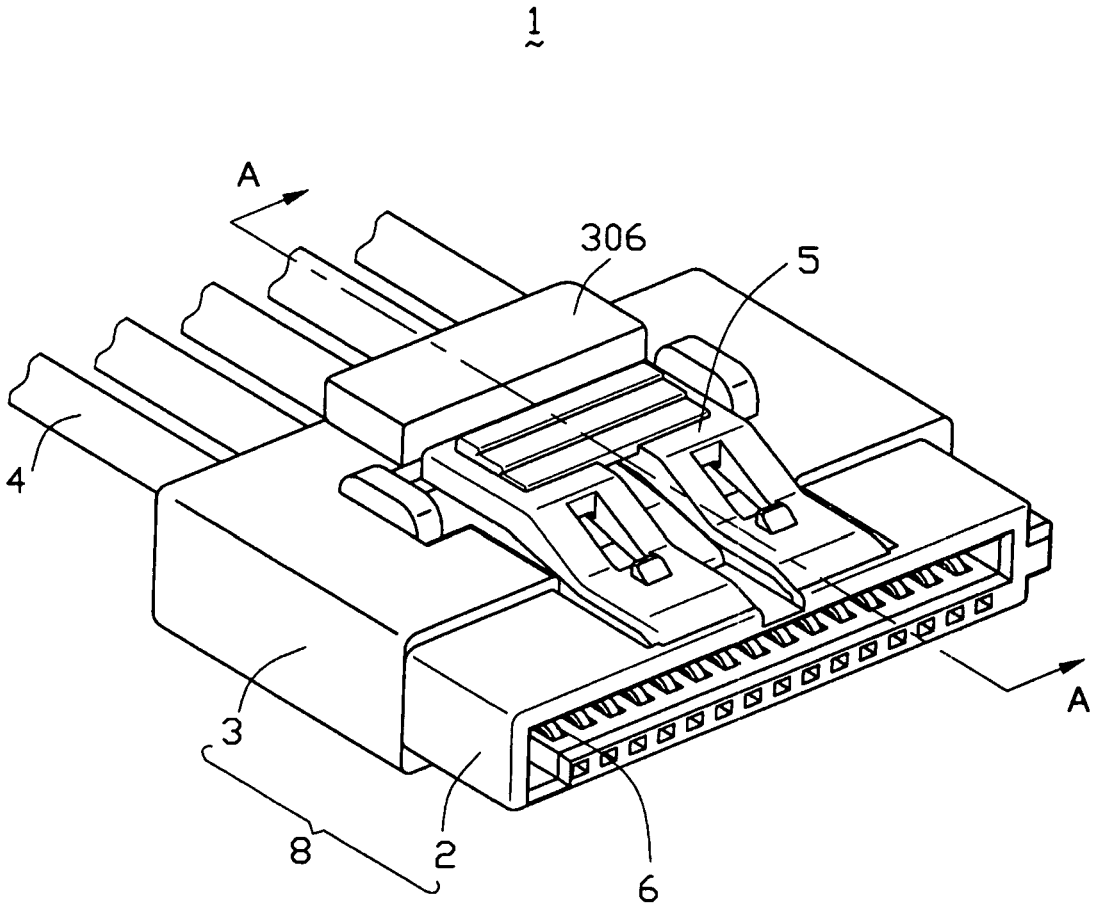
FIG. 1 is a perspective view of an electrical connector in accordance with the present invention.

Referring to FIGS. 1 through 4, an electrical connector 1 in accordance with the present invention comprises a base 8 composed of an insulative housing 2 and an overmold body 3, a plurality of contacts 6 received in the housing 2, and a plurality of cable wires 4 connected to the contacts 6. A positioning piece 7 is optionally provided for sealing purposes during assembling operation of the connector.

The housing 2 has a front mating portion or port 200, a rear portion 201, and a latching element 5 integrally formed on an upper face thereof. The mating portion 200 has two lateral walls 204 and 205 and two side walls 208 and 209. The lateral wall 205 is generally slightly thicker than the lateral wall 204, except for the portion near the side wall 208 so that an L-shaped slot 203 is defined by these lateral walls and side walls. Inside the lateral wall 205 there are a plurality of grooves 207 extending through the mating portion 200 and the rear portion 201 of the housing 2. Extending rearwardly of a central portion of the lateral wall 204 is a slightly recessed flat portion 2040 on both sides of which are formed a pair of raised portions 2041 for preventing the latching element 5 from being accessed or manipulated along a lateral direction. The side wall 209 extends outward to form a rib 206. The rear portion 201 is formed with a plurality of channels (not labeled) in order to increase the securement between the housing 2 and the body 3.

The latching element 5 comprises a first arm 501, a second arm 503, a pressing portion 504 connecting the first and second arms 501 and 503, and an intermediate third arm 502 situated between the first and second arms 501 and 503. The first and second arms 501 and 503 generally slope rearward and upward from approximately a middle upper portion of the lateral wall 204 and comprise, respectively, a junction portion 5051 connected to the housing 2, a depending portion 5053 connected to the pressing portion 504, and a sloped connection portion 5052 connecting the junction portion 5051 to the depending portion 5053. The junction portion 5051 has latch block 505 disposed thereon and, except for its connecting end, is substantially distanced from the flat portion 2040. The depending portions 5053 are connected to the two ends of the pressing portion 504 and arranged substantially parallel to the flat portion 2040. The third arm 502, which is also integrally formed with the housing 2, extends essentially rearward from the lateral wall 204 and continues upward to terminate approximately at a lower intermediate portion of the pressing portion 504. As can be understood, except for its connecting and terminating ends, the third arm 502 is essentially suspended between the pressing portion 504 and the lateral wall 204. It is noted that FIG. 4 clearly shows the connecting ends of the first and second arms 501 and 503 are situated near a front of the housing 2 while the connecting end of the third arm 502 is situated near a rear of the housing 2. A stepped ridge 5040 is provided on the pressing portion 504 to increase the frictional force during pressing the latter.

Figure 2:
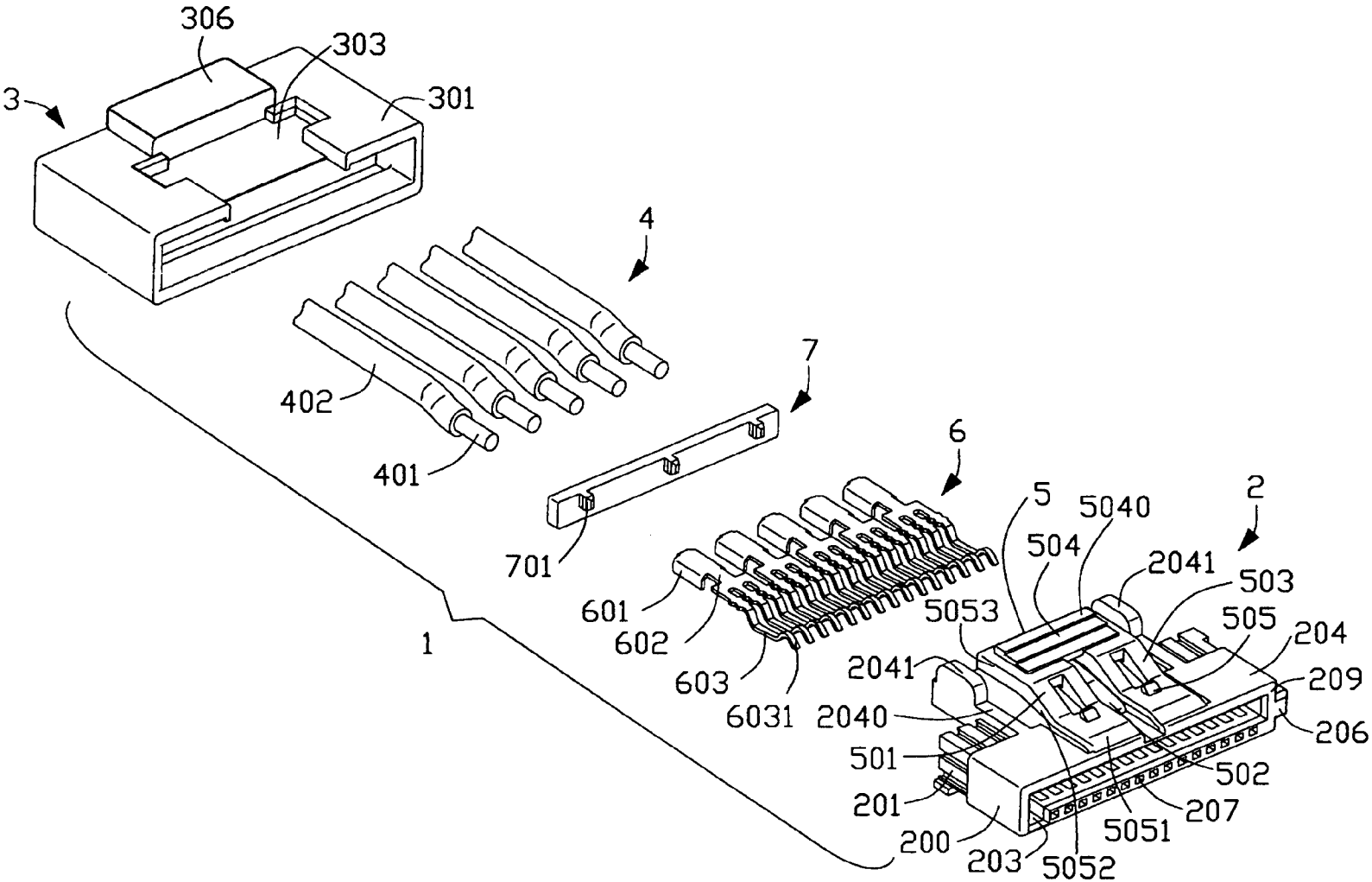
FIG. 2 is an exploded perspective view of the electrical connector.
Figure 3:
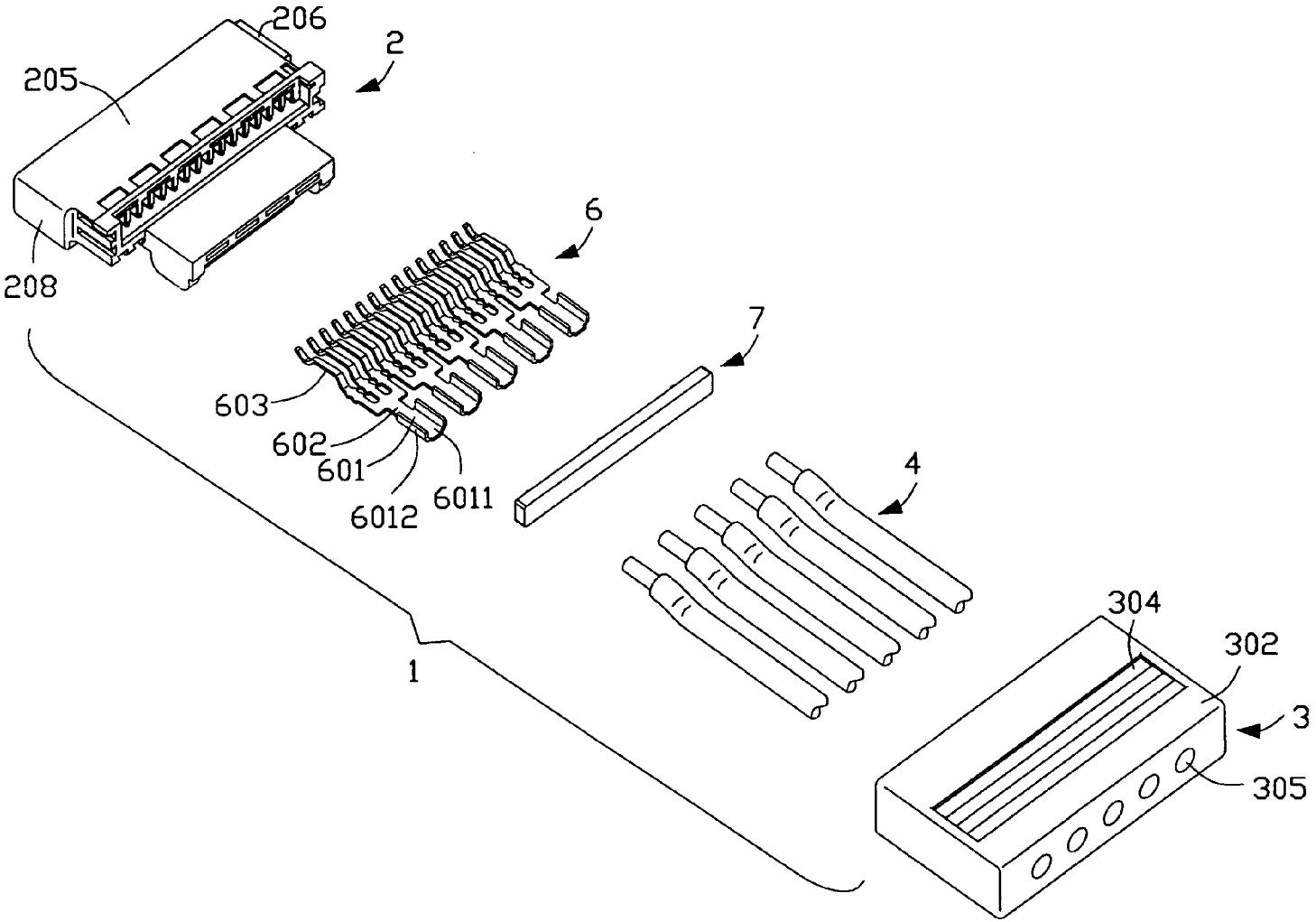
FIG. 3 is another exploded perspective view of the electrical connector.
Figure 4:
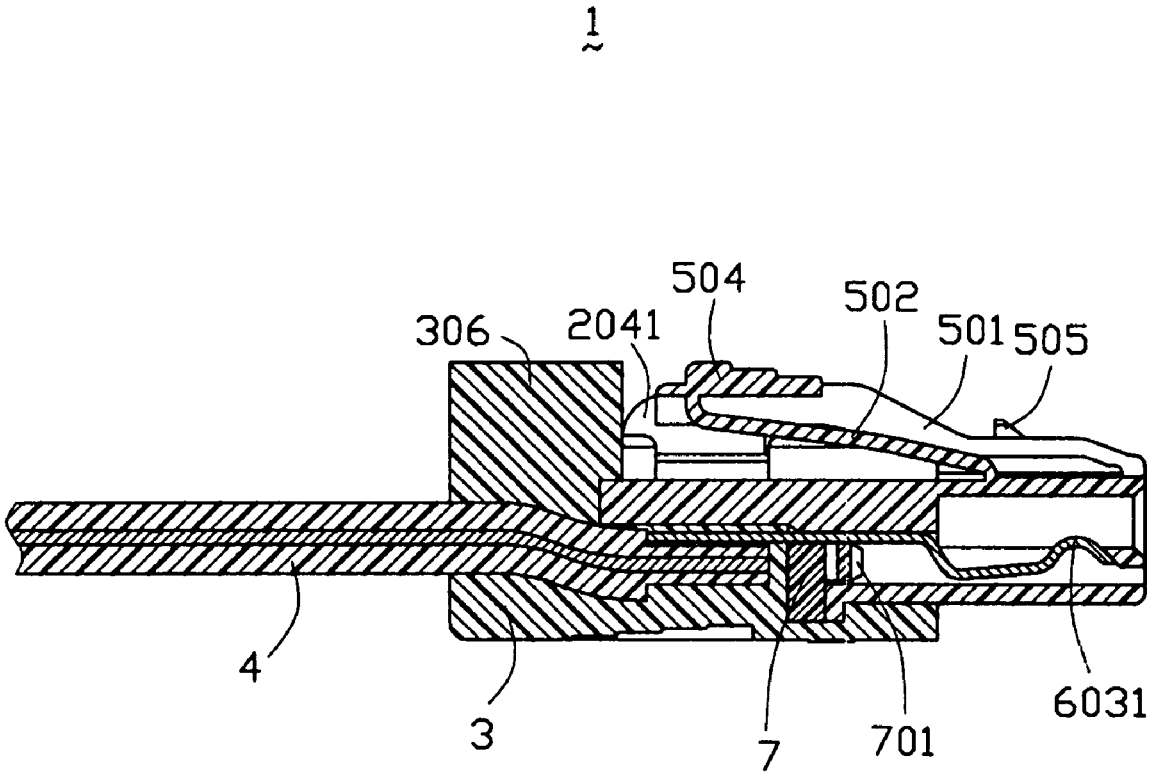
FIG. 4 is a cross-sectional view taken along line A—A in FIG. 1.

The overmold body 3 as shown in FIGS. 2 and 3 is substantially shaped like a rectangular box having an upper surface 301 and a lower surface 302. The upper surface 301 has a slot 303 for accommodating the latching element 5. The lower surface 302 has one or more ridges 304 for ease of being gripped by a user. On the upper surface 301, adjacent to the depending portions 5053 of the arms 501 and 503, there is provided a block 306. While the block 306 in the present embodiment is shown as a single parallelepiped protrusion, it can be understood that the number and shape can be changed and modified as desired. A number of through holes 305 are formed on the rear surface of the body 3 for passing through of the cable wires 4.

As is well known in the art, each cable wire 4 has a conductor 401 and an insulative layer 402 surrounding the conductor 401.

The contact 6 comprises a contacting portion 603, a connection portion 601, and a securing portion connected between the contacting portion 603 and the connection portion 601. The contacting portion 603 has a curved end 6031. Three contacting portions 603 are associated with one common connection portion 601. The connection portion 601 has a web 6011 and two wings 6012 to form a U-shaped structure defining a receiving space for the conductors 401 of the cable wires 4, thereby establishing electrical connection between the cable wire 4 and the contact 6.

The position piece 7 has, on a front surface thereof, one or more ribs 701 for engaging in the grooves 207 of the lateral wall 205 while abutting against the contacts 4 to seal molten plastic from entering in to the grooves 207 during molding the body 3 over the housing 2, which prevents any potential deleterious effects to the electrical connection as might be resulted from.

When the connector 1 is to be connected to a mating connector, the pressing portion 504 of the latching element 5 is pressed down, causing the latch blocks 505 to move down together with the junction portions 5051, so that the two connectors are ready for mating, and after the pressing portion 504 is released, the latch blocks 505 will latch into corresponding grooves or holes in the mating connector, thereby establishing a reliable connection. The block 306 on the body 3 can prevent the depending portion 5053 of the latching element 5 from breakage or damage due to impact or entangling in use. Additionally, the block 306 can assist in conveniently connecting/disconnecting the connecting 1 to/from a mating connector.

It is to be understood, however, that even though numerous characteristics and advantages of the present invention have been set forth in the foregoing description, together with details of the structure and function of the invention, the disclosure is illustrative only, and changes may be made in detail, especially in matter of shape, size, and arrangement of parts within the principles of the invention to the full extent indicated by the broad general meaning of the terms in which the appended claims are expressed.

What is claimed is:

1. An electrical connector comprising:

a base comprising an insulative housing and an overmold body molded over the insulative housing, the housing comprising a pair of raised portion extending rearward beside the latching element and upward beyond an upper surface of the overmold body;

a plurality of contacts received in the base and exposed to a front of the base;

a plurality of cable wires each connected through a rear portion of the base to corresponding contact;

a latching element being unitarily formed with the housing and extending rearwardly; and a block disposed rearwardly of the latching element on the overmold body.

2. The electrical connector as claimed in claim 1, wherein the latching element comprises a pair of side arms, a pressing portion connecting the pair of said arms, and an intermediate arm situated between the pair of side arms.

3. The electrical connector as claimed in claim 1, wherein the latching element and the block are substantially of a same height.

4. The electrical connector as claimed in claim 1, wherein the latching element and the block are substantially of a same width.

5. An electrical connector comprising:

a base made from a first material and having a front portion and a rear portion;

a plurality of contacts received in the base and exposed to the front portion;

a plurality of cable wires each connected through the rear portion to a corresponding contact;

a latching element secured with the base and unitarily extending rearwardly therefrom in one piece; and an overmold body made from a second material and covering the rear portion of the base; wherein a raised block is unitarily formed with the overmold body in one piece, and closely disposed on a rear side of the latching element, said raised block extending above a top face of the overmold body and being configured and dimensioned for not only protecting said latching element but also being grasped during mating/unmating.

6. The connector as claimed in claim 5, wherein said raised block is essentially aligned with said latching element in a front-to-back direction.

7. A method of making an electrical connector, comprising steps of:

injecting molding an unsulative base;

providing said base with a plurality of conductive contacts;

connecting a plurality of cables to the corresponding contacts, respectively;

overmolding an insulative body unto a rear portion of said base; unitarily forming a latching element on said base in one piece, said latching element extending along a front-to-back direction; and providing said body with a raised block, which is unitary with said body in one piece, on a rear side of the latching element; wherein said raised block extends above a top face of the insulative body, and is configured and dimensioned for not only protecting said latching element but also being grasped during mating/unmating.

8. The method as claimed in claim 7, wherein said raised block is aligned with said latching element in said front-to-back direction.

* * * * *